United States Patent [19]

Patton

[11] Patent Number: 4,852,776

[45] Date of Patent: Aug. 1, 1989

[54] DRINKING SPOUT FOR A BEVERAGE CAN

[75] Inventor: Marilyn Patton, Pompano Beach, Fla.

[73] Assignee: Mastodon, Inc., Pompano Beach, Fla.

[21] Appl. No.: 222,178

[22] Filed: Jul. 21, 1988

Related U.S. Application Data

[63] Continuation of Ser. No. 44,752, May 1, 1987, abandoned.

[51] Int. Cl.[4] ..... A47G 19/22; B65D 25/48; B65D 39/00

[52] U.S. Cl. ..... 222/570; 220/90.2

[58] Field of Search ..... 222/566, 569, 570, 573, 222/567, 192, 478; 220/90.2, 90.6, 85 SP

[56] References Cited

U.S. PATENT DOCUMENTS

| | | | |
|---|---|---|---|
| 2,764,325 | 9/1956 | Pellandini | 222/570 |
| 3,197,089 | 1/1964 | Michael | 222/479 |
| 4,023,728 | 5/1977 | Gamberg | 222/570 X |
| 4,299,340 | 11/1981 | Hrytzak | 222/570 X |
| 4,679,702 | 7/1987 | Maccarone et al. | 220/90.2 |

*Primary Examiner*—Kevin P. Shaver
*Attorney, Agent, or Firm*—Oltman & Flynn

[57] ABSTRACT

A spout for attachment to a can having a raised peripheral rim at the top, and a push-in tab in its top which is pushed in by a lift tab, leaving an off-center opening in the can top. The spout has a tubular plastic body of oblong cross-section with a bottom opening at its inner end and an outwardly-facing groove extending around this opening to receive the edge of the can top part-way around the push-in tab opening in it. A flexible and resilient lip extends down and in from the bottom side of the spout body to engage beneath the top peripheral rim of the can.

4 Claims, 1 Drawing Sheet

DRINKING SPOUT FOR A BEVERAGE CAN

CROSS-REFERENCE TO RELATED APPLICATION

This application is a continuation of my U.S. patent application Ser. No. 07/044,752, filed May 1, 1987, now abandoned.

SUMMARY OF THE INVENTION

This invention relates to a spout for attachment to the top of a can having an off-center opening, such as one formed by pushing in and partially severing from the can top an integral push-in tab, as is conventional in many beverage cans.

Preferably, the present spout has a tubular plastic body of oblong cross-section which fits in the opening in the can top and extends upward and laterally outward from it at an acute angle. The spout body at its inner end has a bottom opening for passing the liquid contents from the can into the spout. Around its bottom opening the spout body presents an outwardly-facing groove which closely receives the can top part-way around the edge of its push-in tab opening. Toward its outer end, a flexible and resilient lip extends down and in from the bottom side of the spout body to engage beneath the raised peripheral rim on the top of the can.

A principal object of this invention is to provide a novel spout for attachment to a can at a top opening in the can.

Another object of this invention is to provide such a spout which is particularly adapted for use on beverage cans of conventional design.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
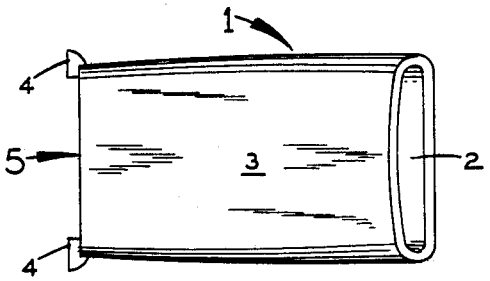
FIG. 1 is a top plan view of the present spout.
Figure 2:
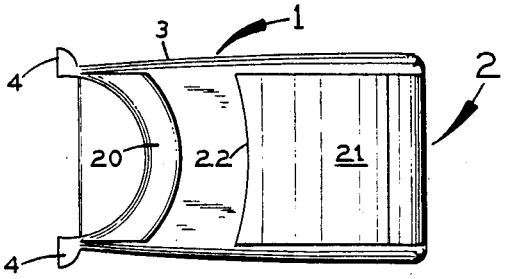
FIG. 2 is a bottom plan view.
Figure 3:
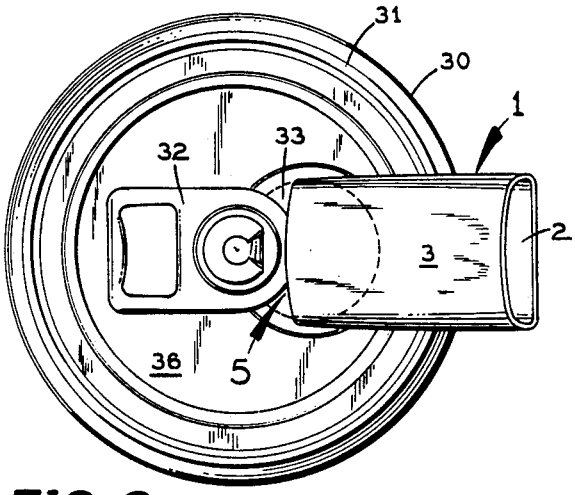
FIG. 3 is a top plan view of the spout on the top of a beverage can having a known type of integral push-in tab and a lift tab for opening the can by pushing in the push-in tab.
Figure 4:
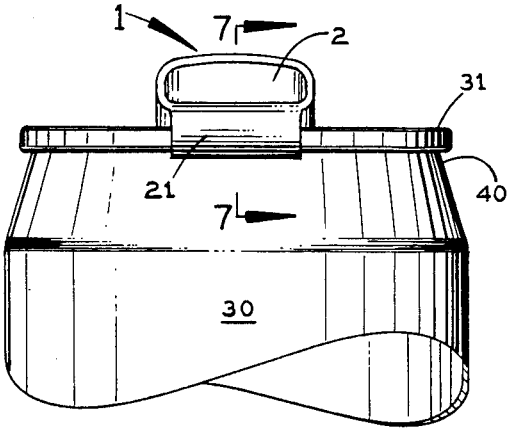
FIG. 4 is an elevational view taken from the right side of FIG. 3.

The spout of the present invention is intended for use on a conventional type of beverage can having an annular body 30 (FIG. 4) extending up from a base (not shown), a top 36 (FIG. 3) closing the upper end of the can body, and a raised peripheral rim 31 encircling the top 36 and projecting a short distance up from it. The can top has an integral push-in tab 60 (FIGS. 6 and 7) of known design which is joined to the remainder of the top along a tear line, here shown as extending for most of the circumference of a circle. However, it is to be understood that this tear line might have a non-circular shape, such as elliptical. Tab 60 is pushed in by a lift tab 32 (FIG. 3) of known design which is attached to the can top by a blister rivet located at the center of the can top.

When tab 60 is pushed in (FIG. 7), it leaves an opening 33 (FIG. 6) in the can top at which the spout of the present invention is attached. Opening 33 is located off-center in the can top, extending from about the center of the can top to close proximity to, but spaced from, the peripheral rim 31 at one side. Between the edge of opening 33 and the closest part of the peripheral rim 31 there remains a part of the can top 35, as best seen in FIG. 7. The size of opening 33 is much less than the area of can top 36 inside the peripheral rim 31.

Figure 5:
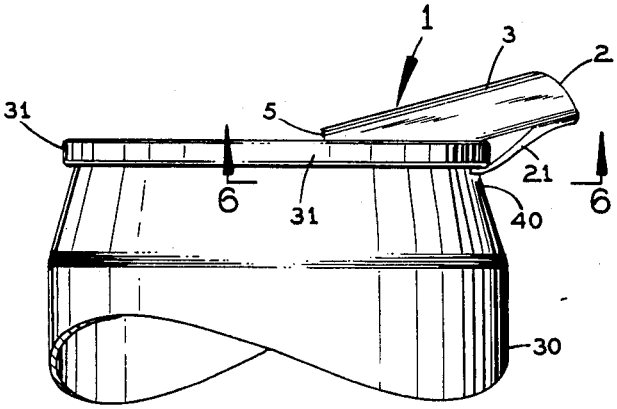
FIG. 5 is an elevational view taken from the bottom side of FIG. 3.

The spout of the present invention is a one-piece molded body of suitable flexible and resilient plastic material including an elongated tubular body 3 of oblong, rounded, approximately elliptical cross-section for most of its length. This body has an inner end at 5 (FIGS. 3 and 5) for attachment to the can top 36 at its opening 33 and an outer end which provides a drinking opening 2 positioned laterally beyond the side of the can and above the top rim 31 of the can.

At its inner end the body of the spout has an opening in the bottom that is bounded by a substantially semi-circular face 6 (FIGS. 6 and 7) which extends about half-way around the opening 33 in the can top. A ring flange 20 on the bottom of spout body extends laterally outward around this bottom opening. The spout body presents a vertically narrow groove or slot (FIG. 7) directly above its ring flange 20 which is open along the laterally outward side of this flange (i.e., the side away from the face 6 of the spout body which defines its bottom opening). This groove is shaped and dimensioned to snugly receive the top of the can at the edge of its opening 33 closest to nearer side of the can (the right side in FIG. 7). The can top is closely received in this groove along slightly less than half the circumference of the can top opening 33, as shown in FIG. 6.

Figure 6:
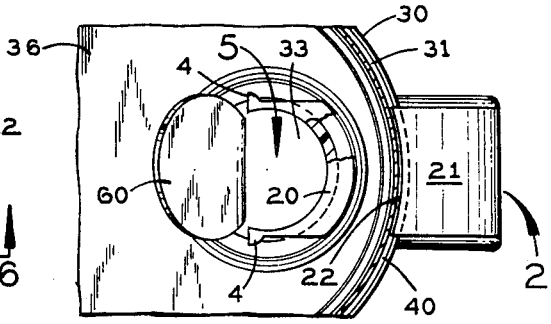
FIG. 6 is a fragmentary horizontal cross-section taken along the line 6—6 in FIG. 5 looking up at the pour opening in the top of the can formed by pushing in its push-in tab.
Figure 7:
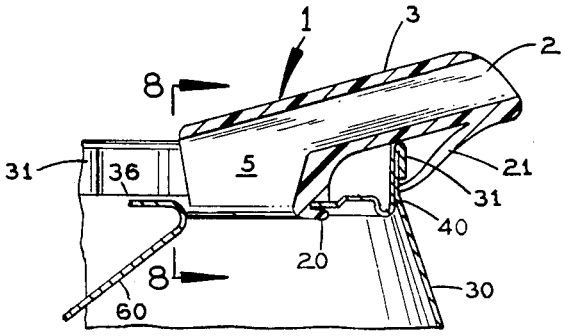
FIG. 7 is a vertical cross-section taken along the line 7—7 in FIG. 4.
Figure 8:
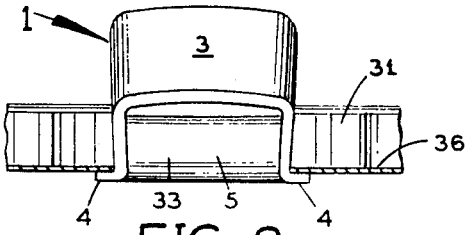
FIG. 8 is a vertical section taken along the line 8—8 in FIG. 7 and showing the inner end of the spout in elevation.

At the opposite ends of its substantially semi-circular face 6, the spout body is formed with outwardly projecting corner flanges 4 on the bottom which extend closely beneath the can top 36 just beyond the edge of opening 33, as shown in FIGS. 6 and 8.

A flexible and resilient lip 21 (FIG. 7) is joined to the bottom side of the tubular spout body 3 laterally outward from the groove above its ring flange 20. This lip extends inward toward this groove and terminates in an inner edge which is spaced below the bottom side of the spout body and engages the outside of the can 30 immediately below the peripheral top rim 31 of the can.

With this arrangement, the spout is manually attachable to and releasable from the top of the can, with the groove above the spout's ring flange 20 snugly receiving the top of the can part-way around the edge of its opening 33, the corner flanges 4 on the spout engaging beneath the can top on opposite sides of this opening, and the lip 21 on the spout engaging the outside of the can directly below its top rim 31 and holding the inner edge of the groove above the spout's ring flange 20 against the edge of the can top opening 33. The spout can be mounted on the can at the can top opening 33 from either end of its ring flange 20, which makes it easy to slide the entire ring flange under the top of the can at the edge of this opening. If desired, the tubular body 3 of the spout can be manually deformed by squeezing together its sides at the opposite ends of the edge 6 of the opening at its inner end to make it easier to mount on the can. The present spout can fit can top openings of different sizes and shapes.

As shown in FIG. 7, when the spout is attached to the top of the can, the top side of its tubular body 3 is spaced above the can top 36 at the inner end of body 3, and the inner end is open below its top side to pass air into the can when its liquid contents flow out through the spout.

I claim:

1. A spout for attachment to a can having a top bounded by a raised peripheral rim and an opening in the top located off-center toward one side of the can and spaced from said rim on said one side of the can, said top of the can being thin vertically and substantially flat circumferentially around said opening, said spout comprising:

a tubular plastic body having an inner end for attachment to the can at said opening therein and an outer end providing a drinking opening laterally outward beyond and above said rim at said one side of the can;

said tubular body having a bottom side with an opening at its inner end bounded by an arcuate edge that extends only part-way around said opening in the top of the can;

said body having a passageway extending from said opening at its inner end to said drinking at its outer end;

said body on its bottom side having a vertically narrow groove which is located laterally outward from said arcuate edge of said opening at its inner end and extends substantially completely around said arcuate edge, said groove being open toward said one side of the can to snugly receive the top of the can part-way around the edge of said opening in the top of the can;

and a flexible and resilient lip spaced from said body and extending from said bottom side of the body downwardly and rearwardly at an angle toward said groove and terminating in an inner edge spaced below said bottom side of the body and spaced outward from said groove;

said groove and said lip being positioned so that when said groove receives the top of the can part-way around the edge of said opening therein said lip engages beneath said peripheral rim on the can to manually releasably attach said body to the top of the can.

2. A spout according to claim 1 wherein:

said tubular body has a top side which at the inner end of said body is spaced above the top of the can when the spout is attached to the top of the can;

and said body is open at its inner end below said top side to admit air into the can.

3. A spout according to claim 1 wherein said tubular body is manually deformable at its inner end by squeezing together its sides at the opposite ends of said arcuate edge of the opening at its inner end.

4. A spout according to claim 3 wherein:

said tubular body has a top side which at the inner end of said body is spaced above the top of the can when the spout is attached to the top of the can;

and said body is open at its inner end below said top side to admit air into the can.

* * * * *